US011998855B2

(12) United States Patent
Hakuta

(10) Patent No.: US 11,998,855 B2
(45) **Date of Patent: *Jun. 4, 2024**

(54) FLOATING OBJECTS AND METHOD FOR MAINTAINING THE OBJECTS IN CONTAINED ENVIRONMENT

(71) Applicant: SUMMIT ENTERTAINMENT VENTURES LLC, New York, NY (US)

(72) Inventor: David Kenzo Hakuta, New York, NY (US)

(73) Assignee: SUMMIT ENTERTAINMENT VENTURES LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/111,893

(22) Filed: Feb. 21, 2023

(65) Prior Publication Data

US 2023/0330552 A1 Oct. 19, 2023

Related U.S. Application Data

(63) Continuation of application No. 17/382,801, filed on Jul. 22, 2021, now Pat. No. 11,617,963.

(51) Int. Cl.
*A63H 27/10* (2006.01)
*A63J 13/00* (2006.01)

(52) U.S. Cl.
CPC ..... *A63H 27/10* (2013.01); *A63J 13/00* (2013.01); *A63H 2027/1008* (2013.01); *A63H 2027/1025* (2013.01); *A63H 2027/1041* (2013.01)

(58) Field of Classification Search
CPC ..... A63H 27/10; A63H 2027/1008; A63H 2027/1025; A63H 2027/1041; A63H 2027/1058; A63H 2027/1066; A63H 2027/1075; A63J 13/00
USPC ..... 446/220, 221, 222, 223, 224, 225, 226
See application file for complete search history.

(56) References Cited

U.S. PATENT DOCUMENTS 4,888,836 A * 12/1989 Calderwood ..... A47C 17/84 297/DIG. 3
4,931,028 A * 6/1990 Jaeger ..... A63H 30/04 244/30
5,031,908 A * 7/1991 Spector ..... A63F 9/305 273/458
5,080,625 A * 1/1992 Huffhines ..... A63F 9/02 446/225
5,227,922 A * 7/1993 Boos ..... G02B 27/024 359/857
5,381,779 A * 1/1995 Shelton ..... A63H 37/00 244/31
5,727,700 A * 3/1998 Digney ..... A47F 5/0892 211/119
5,743,786 A * 4/1998 Lindsey ..... A63H 33/048 446/221

(Continued)

*Primary Examiner* — Joseph B Baldori
(74) *Attorney, Agent, or Firm* — Greenberg Traurig, LLP

(57) ABSTRACT

A room installation is provided having at least three walls, a ceiling and floor, all of which are covered in a mirrored surface. At least one transparent window allows ambient light into the room installation. A plurality of mirrored balloons are arranged within the room installation, and filled with helium, but otherwise weighted, to float substantially within a middle height of the room installation.

8 Claims, 8 Drawing Sheets

(56) References Cited

U.S. PATENT DOCUMENTS

| | | | | | |
|---|---|---|---|---|---|
| 5,765,831 | A * | 6/1998 | Huffhines | A63H 27/10 | 273/DIG. 30 |
| 5,797,783 | A * | 8/1998 | Harris | A63H 27/10 | 40/124.05 |
| 5,893,790 | A * | 4/1999 | Montgomery | A63H 27/10 | 446/225 |
| 5,906,335 | A * | 5/1999 | Thompson | F02B 75/34 | 244/92 |
| 6,019,660 | A * | 2/2000 | Luciano | A63H 27/10 | 446/223 |
| 6,149,495 | A * | 11/2000 | Austin | A63J 5/028 | 406/102 |
| 6,238,067 | B1 * | 5/2001 | Hirsch | F21V 23/04 | 362/399 |
| 7,581,835 | B1 * | 9/2009 | Walker | G03B 21/00 | 372/15 |
| 8,303,367 | B2 * | 11/2012 | English | A63H 27/10 | 244/31 |
| 9,480,930 | B2 * | 11/2016 | Bergmann | A63H 27/10 | |
| 10,717,017 | B2 * | 7/2020 | Publicover | A63H 27/10 | |
| 10,843,098 | B1 * | 11/2020 | Simonsen | A63H 27/10 | |
| 10,994,217 | B2 * | 5/2021 | Lopez Diaz | A63H 27/10 | |
| 11,156,353 | B2 * | 10/2021 | Diamonds | F21L 14/00 | |
| 11,316,470 | B2 * | 4/2022 | Unal | H02S 40/425 | |
| 11,422,454 | B1 * | 8/2022 | Yett | G03B 21/562 | |
| 11,617,963 | B2 * | 4/2023 | Hakuta | A63J 13/00 | 446/220 |

* cited by examiner

FLOATING OBJECTS AND METHOD FOR MAINTAINING THE OBJECTS IN CONTAINED ENVIRONMENT

RELATED APPLICATION

This application claims the benefit of priority to U.S. patent application Ser. No. 17/382,801, filed on Jul. 22, 2021, the entirety of which is incorporated by reference.

FIELD OF THE INVENTION

This application relates to floating objects and floating objects in a contained, possibly mirrored, environment. More particularly, the present arrangement relates to inflatable objects floating in air, and a system and method for maintaining and/or circulating objects in a contained mirrored environment.

DESCRIPTION OF RELATED ART

It is well known to use helium to inflate balloons so that they float in air as helium is less dense than air. However, helium filled balloons tend to be basic in design and float upwards, essentially indefinitely, so that they would rise upwards until reaching air in the atmosphere that is of equal or lesser density. In a closed environment such as a room helium filled balloons rise to the ceiling and remain there.

In some instances, to have such balloons remain at mid room height, a string may be tied to the bottom of the balloon which is attached to a weight. However, these arrangements have an unsightly string, and they also remain statically placed within a space and can only be moved manually.

Such balloons may be used to fill rooms or ad atmosphere to the décor. However, the balloons are typically temporary and do not directly reflect the décor of the room or add to the perception of the space itself. In other words, the balloons are usually independent from the ambience or color/surface appearance of the walls.

OBJECTS AND SUMMARY

The present arrangement looks to provide floating objects, such as balloons that appear to float and move around a confined space, neither sinking fully to the ground nor raising only to the ceiling. Moreover, such objects can preferably be of mirrored or reflective nature to divert light paths passing though the center of a room or event space. This arrangement of mirrored balloons may be combined with mirrored wall surface to produce a combined visual effect. Moreover, the addition of a single open wall to allow ambient light to reflect off of both the walls and the balloons create a dynamic aesthetic effect not previously available in the prior art.

Additionally, the present arrangement further maintains an air flow management system and method to simultaneously contain the floating objects within a given space and also to move them around the space to give the illusion of self-propulsion. This keeps the mirrored balloons moving within the room in a manner to constantly change the interaction between themselves and the mirrored walls to produce a continuously changing visual effect.

In addition, a series of lights, either on a constantly changing pattern or on a steady pattern, can be added to the mirrored room to diversify the visual pattern to reflect off of both the walls and mirrored balloons.

To this end the present arrangement provides for a room installation having at least three walls, a ceiling and floor, all of which are covered in a mirrored surface. At least one transparent window is provided for allowing ambient light into the room installation. A plurality of mirrored balloons are arranged within the room installation, and are filled with helium, but otherwise weighted, to float substantially within a middle height of the room installation.

The plurality of balloons are made of Polyethylene Terephthalate and are of different sizes. The plurality of balloons are weighted with a latex/polymer preservative of water, polyvinyl alcohol, and dextrose monohydrate, wherein said amount of preservative is sufficient to prevent the helium filled balloons from rising to the ceiling, but is not excessive to hold the balloons to the floor. The room installation further has at least one air vent for circulating and/or moving the balloons with said room installation.

BRIEF DESCRIPTION OF DRAWINGS

The present invention can be best understood through the following description and accompanying drawing, wherein.

DETAILED DESCRIPTION

Figure 1:
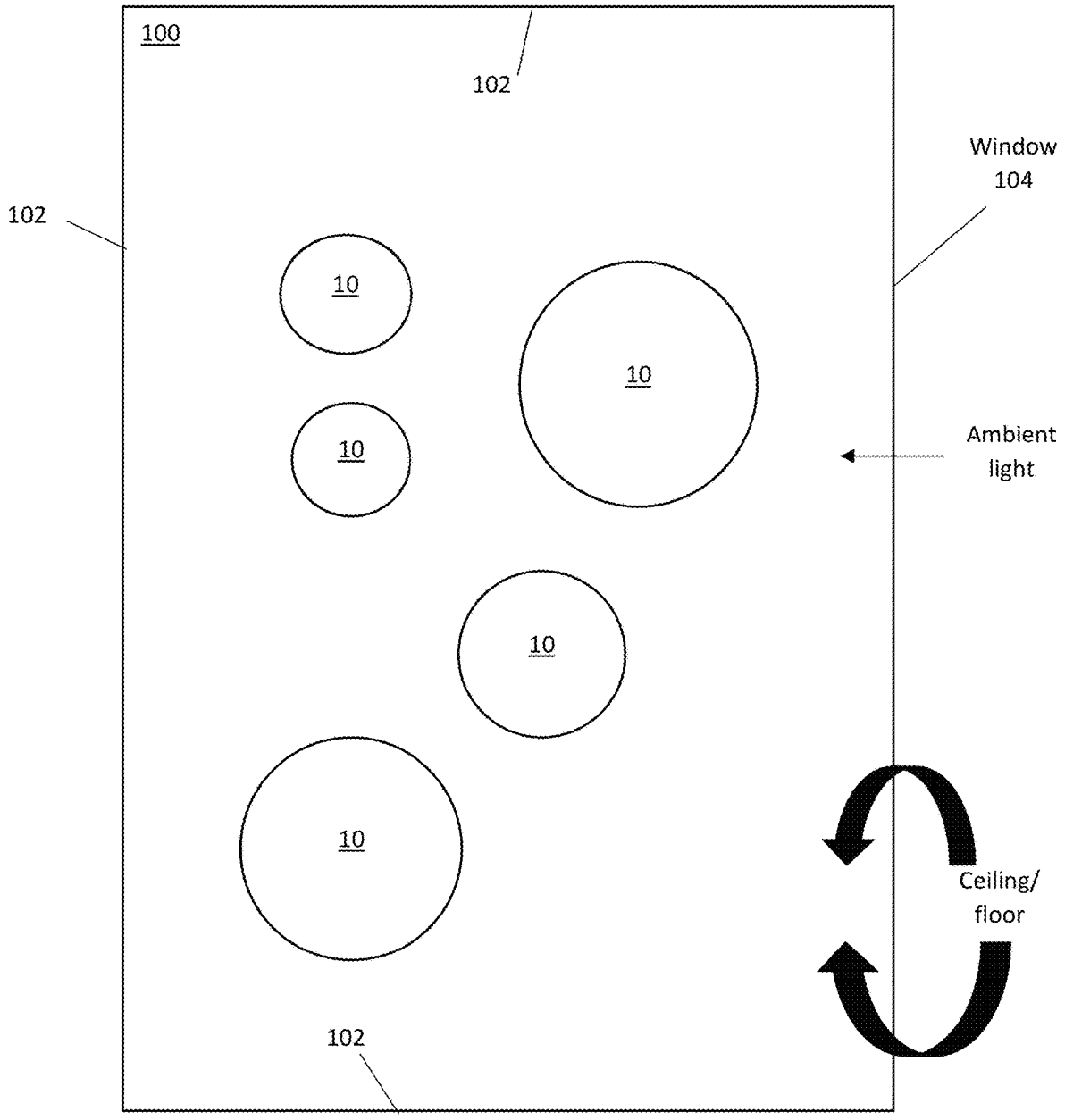
FIG. 1 illustrates a room filled with balloons according to one embodiment of the invention.

In one embodiment as illustrated in FIG. 1, a series of floating objects such as inflated balloons 10 are shown within a room 100. In one preferred embodiment, and for the purposes of illustration, room 100 is covered in a series of mirrors 102 and inflated balloons 10 likewise have a mirrored surface. Although some of the salient features of the invention maybe used without mirrored or reflective surfaces, for the purposes of illustration, balloons 10 and room/mirrors 100/102 are described as covered in reflective surface. For example, room 100 is ideally a room where all but one of the surfaces is covered completely by mirrors with the final open side wall being defined by a transparent window 104 Optionally lighting elements may be included for visual effects as discussed in more detail below.

Such an arrangement with one transparent window 104 will allow room 100 to be filled with ambient light and imagery that is captured and an essentially infinitely reflected off of walls 102 as well as balloons 10. For example, placement of room 100 in a city setting would capture the image or skyline of the city through window 104 and reflect it off of the walls 102 and balloons 10 in a repeating pattern as the light continuously bounces between walls, floor and ceiling, as well as balloons 10. The same such room 100 placed in an ocean setting (e.g. on a cruise ship) or in a nature setting (e.g. in a forest canopy or pastoral setting) would likewise capture the ambient light patterns from such scenery and reflect the light in a continuous repeating pattern off of walls 102 and balloons 10.

More particularly, regarding the aspect of the balloons 10, as shown in FIG. 1, the arrangement shown involves a plurality of balloons 10 of various diameters filled with a gas such as helium to allow them to float. In some arrangements balloons 10 may be fitted with one or more weights 12 that counter-balance the helium to allow balloons 10 to float essentially within the confines of the middle of room 100, neither falling to the floor nor rising only to the ceiling. Essentially, balloons 10 are filled with helium and then simultaneously weighted with a balanced weight so that balloon 10 floats within the airspace of room 100 without sticking to the ceiling of room 100.

Beginning with the process of filling, balloons 10 are preferably made of reflective Mylar™ (Polyethylene Terephthalate) and may be of several difference sizes as shown in FIG. 1. Such sizes can include Mylar Size 1 (7" inflated); Mylar Size 2 (9" inflated); Mylar Size 3 (11" inflated); Mylar Size 4 (14" inflated); Mylar Size 5 (16" inflated); and Mylar Size 6 (22" inflated). The ideal shape for balloons 10 is round, but other shapes may be used if desired.

Figure 2A:
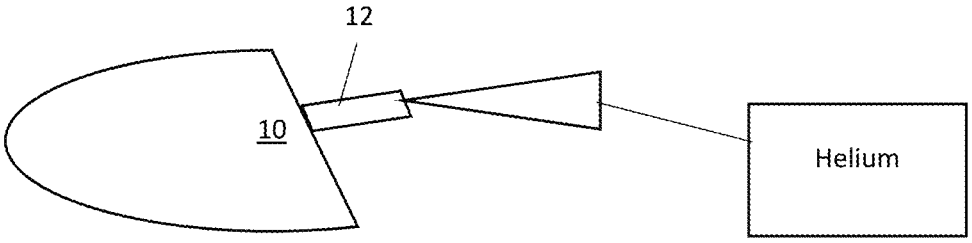
FIGS. 2*a* and 2*b* illustrates a balloon during the inflation and sealing process according to one embodiment of the invention.
Figure 2B:
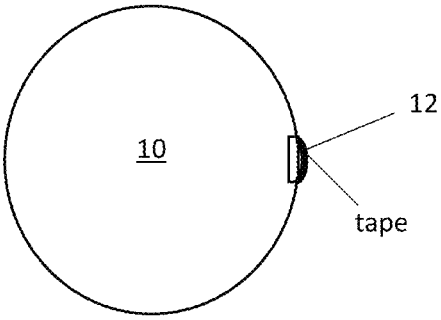

As shown in FIG. 2*a*, as part of the filling process, balloons 10 are filled and sealed according to a preferred series of steps which can include attaching a balloon nozzle extension 12 to the nozzle of a helium tank. Balloon 10 is filled until its seams flatten out (i.e. achieves filled round state) and then shipping tape 14 can be used to secure/flatten the inflation point at nozzle extension 12, sealing in the helium and closing balloon 10. FIG. 2*b* shows balloon 10 inflated with nozzle extension closed and with tape.

Figure 3:
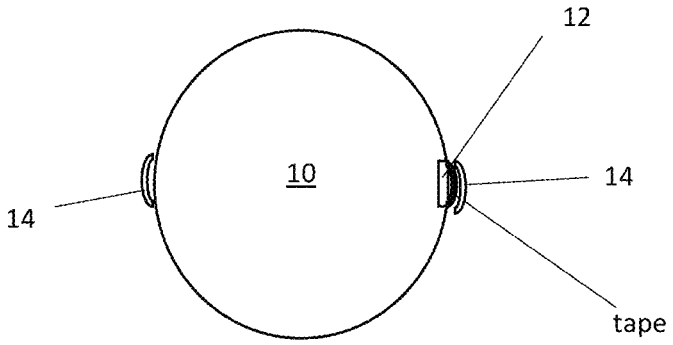
FIGS. 3 and 4 illustrate a completed balloon with weighted washers, pads and patches, according to one embodiment of the invention.

After filling, a washer 14 maybe attached over the closed nozzle extension 12 and a second washer may be placed on the opposite side of balloon 10 for balance. FIG. 3 shows an exemplary placement of two washers 14 on either side of balloon 10, one over closed nozzle 12 and the other positioned on the opposite side. The washer 14 pair, per balloon 10, is usually the same weight for balance, but it is noted that washers 14 can be of different sizes and weights, larger for larger balloons 10, so that helium can be appropriately balanced for different sized balloons 10. The placement of washer 14 over nozzle 12 helps cover the nozzle for aesthetic purposes and the use of diametrically opposed washers 14 helps balance the balloons 10 as they float and rotate in the air in room 100. If only a single weight was used, balloons 10 would only float in the air and have an odd float pattern with a single washer always at the bottom. However, with separated weights 14, balloons 10, as they move around the air of room 100 in a spinning motion and react more "naturally" as a floating object.

Figure 4:
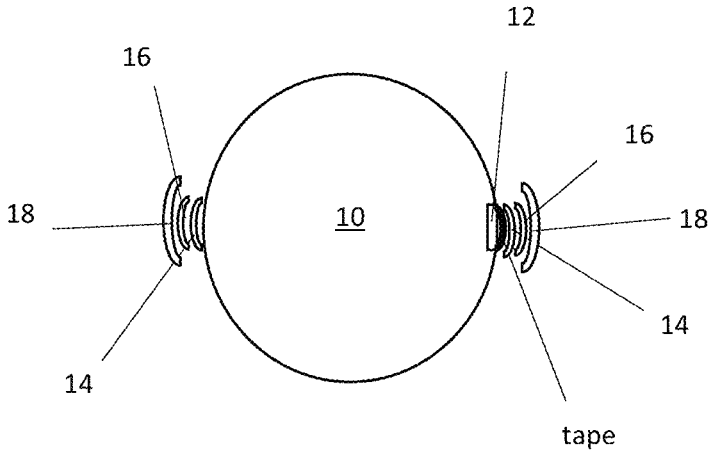
Figure 5:
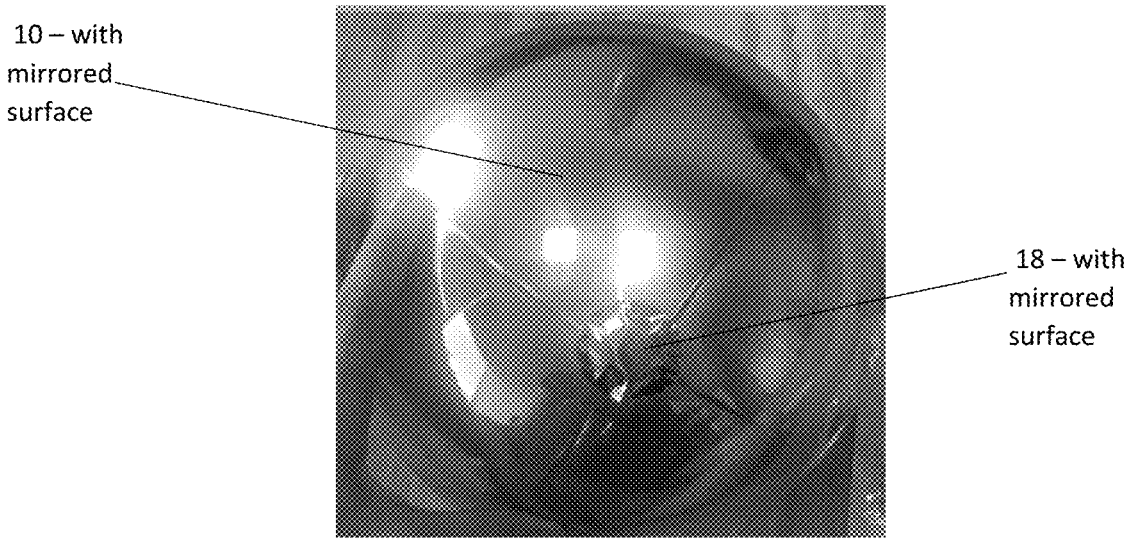
FIG. 5 is an image of an inflated and patched balloon according to one embodiment of the invention.

In order to maintain a mirrored surface on the outside of balloon 10 and to match the mirrored outer surface a combination pad 16 and Mylar patch 18 are fitted over washers 14. Pad 16 and Mylar patch 18 can be two separate items or combined into a single element. Pad 16 prevents washers from chipping mirrors 102 in room 100 as balloon 10 moves around and occasionally contacts the surfaces. FIG. 4 shows balloon 10 in its final inflated form with washers 14 and pads/patches 16/18. The view in FIG. 4 is expanded for clear illustration, but in practice, washer 14, pad 16 and Mylar patch 18 essentially make a smooth continuous surface with the outside of balloon 10 to maintain an essentially continuous mirrored outer surface as shown in exemplary FIG. 5.

In an alternative arrangement instead of using washers 14 for weighting balloons 10 (or possibly in combination with washers 14), prior to filling balloon 10 according to the above descriptions, balloons 10 may be prefilled with a Latex/polymer preservative such as HiFloat™ (water, polyvinyl alcohol, and dextrose monohydrate). Such preservatives are used to help seal the inside of balloons 10 so as to retain the helium as long as possible. However, the preservative liquid used inside of balloon 10 itself can be metered for weight to take the place of washers 14 (or possibly used in combination with washers 14).

Figure 6:
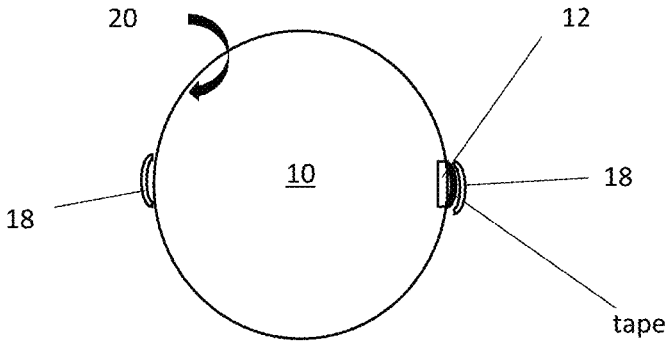
FIG. 6 illustrates an inflated and patched balloon with a sealant according to one embodiment of the invention.

For example, as shown in FIG. 6, balloon 10 can include an inside Latex/polymer coating 20 spread on the inside surface, with the same mylar patch 18 used over fill opening 12. The amount of coating 20 used can be adjusted depending on the size/volume of balloon 10 in order to allow balloon 10 to "hang" in the middle of event room 100 when its volume is filled with helium. In other words, the helium would cause balloon 10 to rise, however the weight of coating 20 is just enough to cause it to fall part way back to the ground but not all the way to the ground, essentially in balance with the helium's lift. The amount of coating 20 used may be adjusted depending on the size/volume of balloon 10 as well as expected effects of temperatures and elevation from sea level depending on where room 100 is located.

Figure 7:
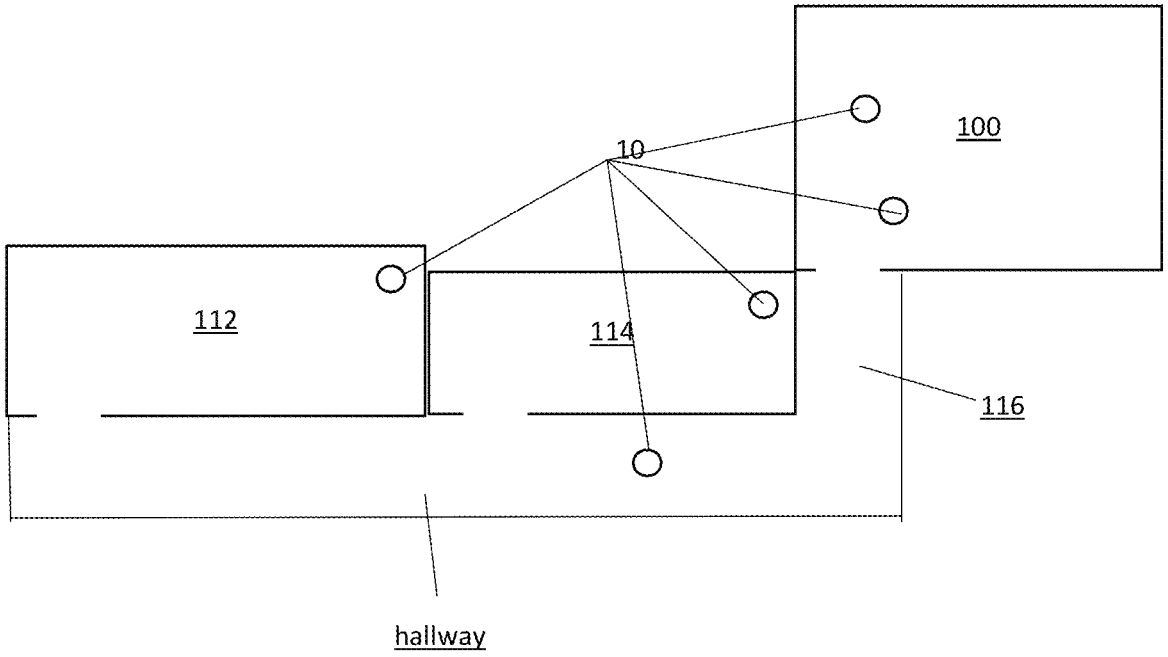
FIG. 7 illustrates a room installation including an event room as well as staging areas, in accordance with one embodiment.

Turning to the arrangement, floatation, and rotation of balloons 10 within room 100, FIG. 7 shows an exemplary arrangement for staging area and installation. As shown in FIG. 7, installation room 100 is associated with a filing room 112, a staging holding room 114, and an entrance corridor 116. Entrance corridor exits into room 100 where balloons 10 are arranged to float as shown above in FIG. 1. Filling room 112 has the appropriate equipment to fill and seal balloons 10, input sealant 20 and add Mylar patches 18. After being filled, balloons 10 are staged and held in holding room 114 which acts as a reserve for balloons so that installation 100 operators can control the volume of balloons 10. As more balloons are needed in room 100, balloons 10 are retrieved and proceeded down entrance corridor 116 that opens in to room 100.

In another embodiment of the present arrangement room 100 is provided with one more vent structures 200. Vents 200 are used to keep balloons 10 moving in a designated pattern within room 100. As noted above, balloons 10 are filled and weighted to float essentially in the middle of the room (approximately) neither rising all the way to the ceiling or falling and holding to the floor. Vents 200 can be placed around room 100 to foster movement of the balloons either in a single direction or in a circulating pattern.

Figure 8:
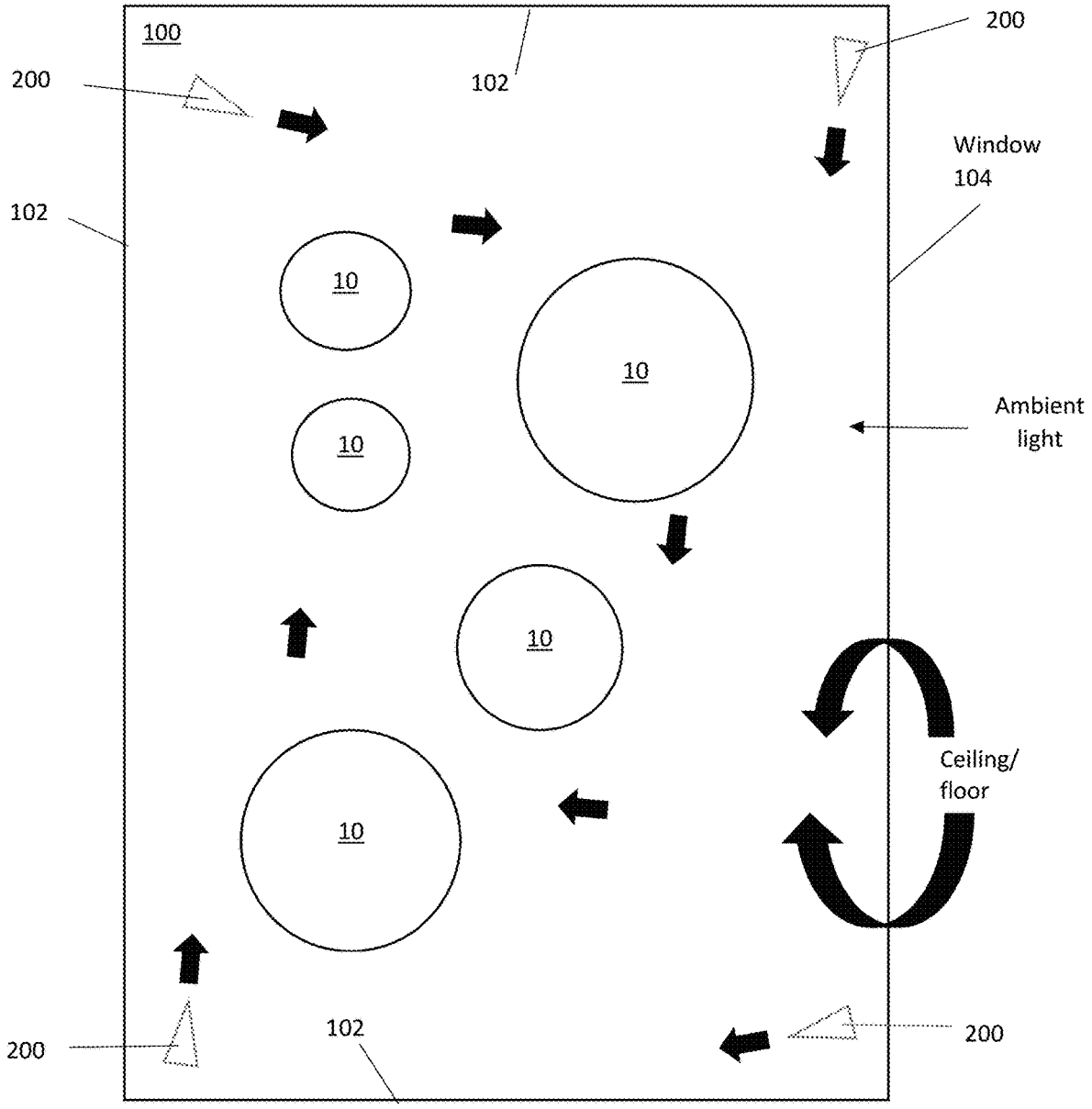
FIG. 8 illustrates a room filled with balloons and vented movement of the balloons according to one embodiment of the invention.
Figure 9:
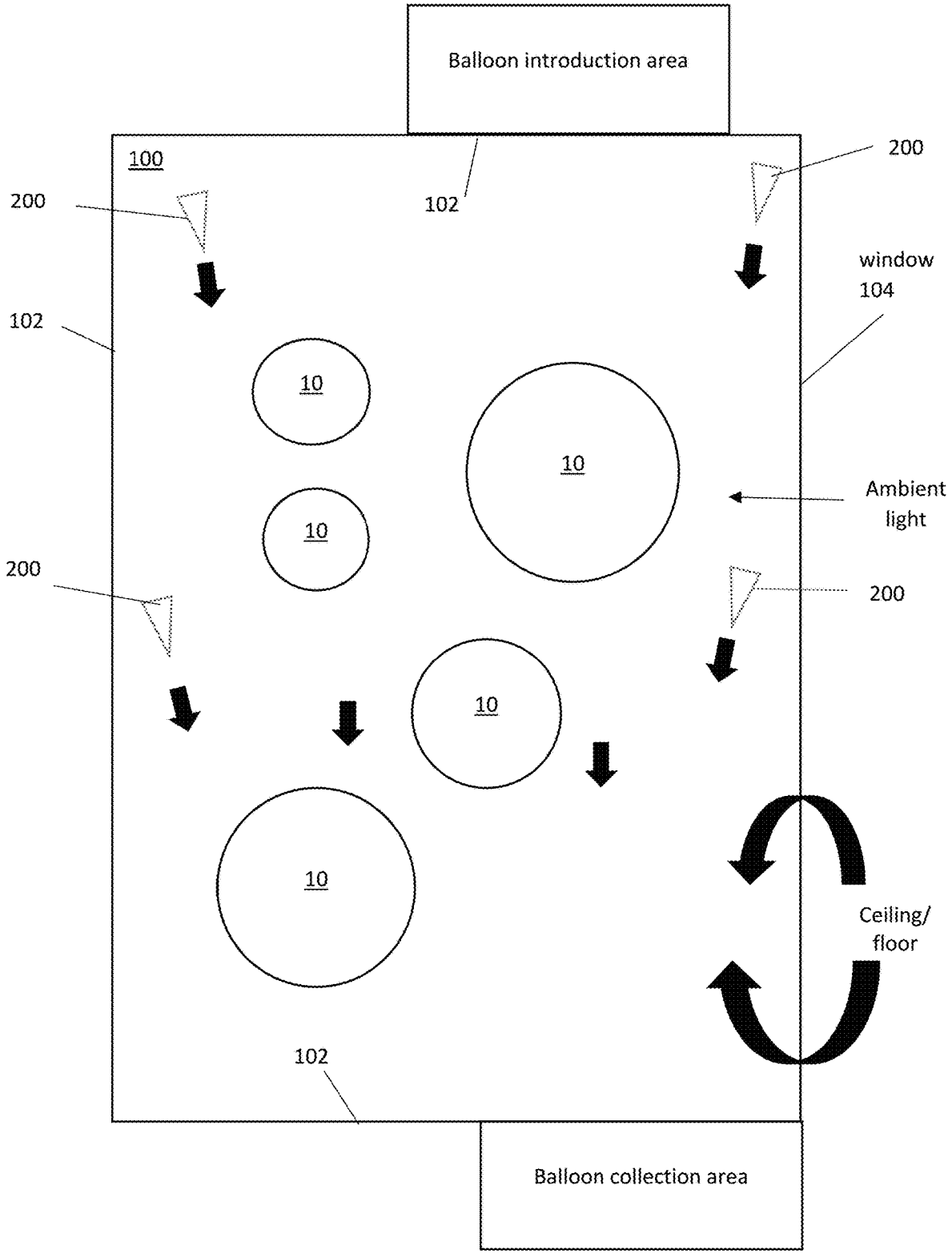
FIG. 9 illustrates a room filled with balloons and vented movement of the balloons according to another embodiment of the invention.

FIG. 8 shows room 100 with an exemplary four vents 200 located on different sides of room 100, either near the ceiling or floor (or other discrete locations) to move balloon 10 in a rotating pattern. FIG. 9 shows room 100 with an exemplary four vents 200 located on different sides of room 100, either near the ceiling or floor to move balloon 10 in a single direction (possibly to a far side holding room not shown for eventually repositioning at a start location on the opposite side of the room). The various options for vents 200 and patterns for moving balloons 10 within room 100 are too numerous to detail in full. However, the general principal is to have the air speed of vents 200 to move balloons 10 in any one of a slow, medium, or fast pattern so that the interaction between their mirrored surfaces, mirrored walls 102 and the open window 104 provides a constantly changing visual landscape. People walking within room 100 experience a changing light dynamic as the ambient light enters through window 104 and then bounces off of mirrored walls/floors/ceilings 102 as well as moving balloons 10 in an ever-changing experience. Vents 200 may be configured as part of the ordinary air condition heating vents in room 100, applied and directed as above for patterned balloon 10 movement, or they may be made from an independent air moving system solely for moving balloons, or some combination of the two.

Figure 10:
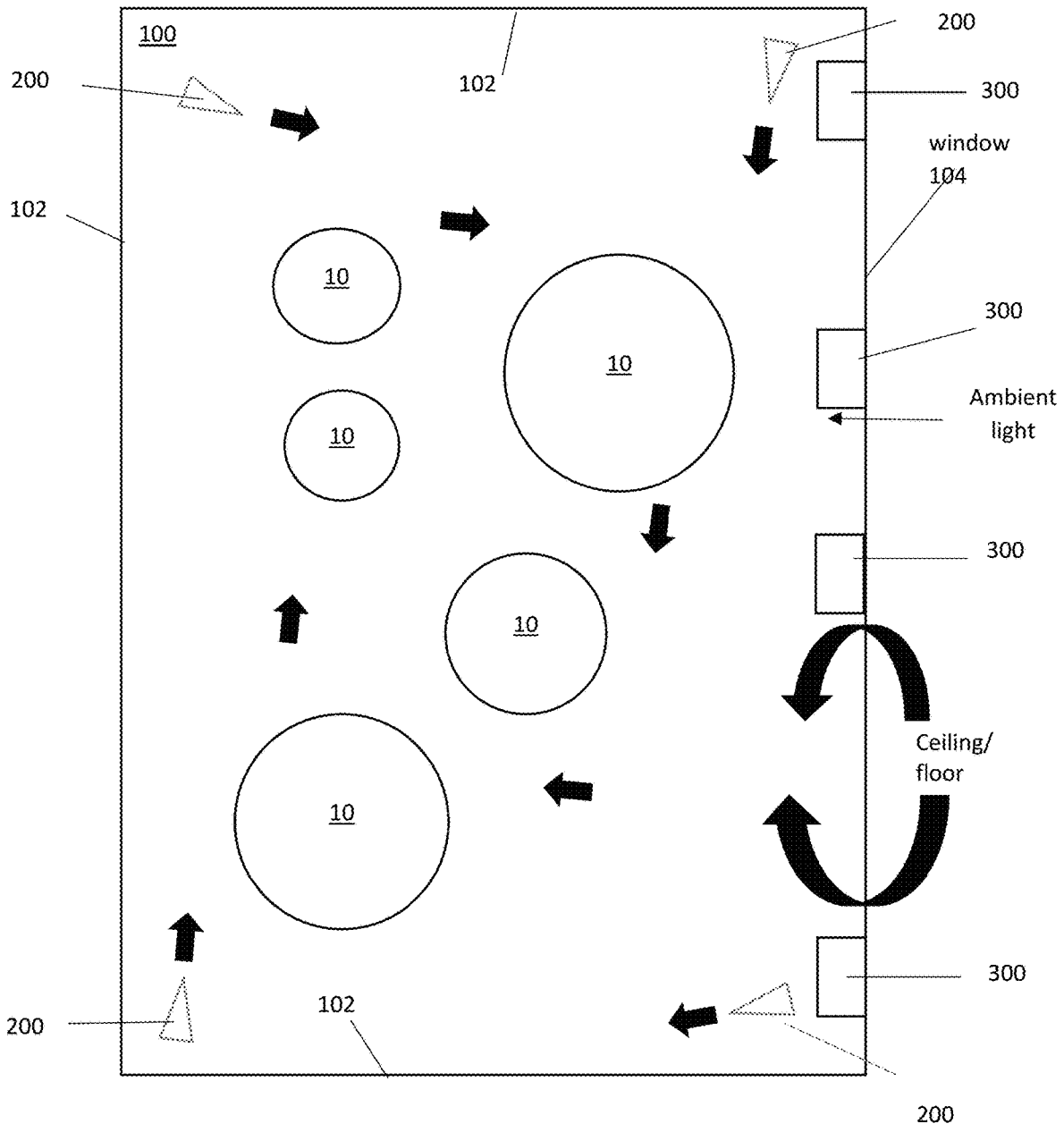
FIG. 10 illustrates a room filled with balloons and vented movement of the balloons, with the addition of light elements, according to one embodiment of the invention.

In another embodiment shown in FIG. 10, room 10 may have lights 300 added to room 100 to include an additional visual aspect to interact with mirrored walls 102, mirrored balloons 10 and the ambient light entering through window 104. As shown in FIG. 10, in this embodiment lights 300 are vertical column lights (e.g. approximately floor to ceiling) disposed across the front window 104 of room 100 so that the lights interact with the ambient light entering room 100. The lights can be for example colored or white lights, that are either set to steady or sequence flashing. Such lights would reflect off of the mirrored walls/ceiling/floor 102 as well as mirrored balloons 10 providing an additional dimension to the light dynamic within room 100.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A room installation comprising:

at least three walls, a ceiling and floor, all of which are covered in a mirrored surface;

at least one transparent window configured to allow ambient light into the room installation; and a plurality of mirrored balloons arranged within the room installation, and filled with helium, but otherwise weighted, to float substantially within a middle height of the room installation, wherein the room installation further comprises a plurality of air vents configured to at least one of circulate or move the mirrored balloons within the room installation, the air vents configured to move the mirrored balloons in a designated pattern within the room installation, generating a constantly changing visual landscape.

2. The room installation as claimed in claim 1, wherein the plurality of mirrored balloons are made of polyethylene terephthalate and are of different sizes.

3. The room installation as claimed in claim 1, wherein the plurality of mirrored balloons are weighted with a polymer preservative of water, polyvinyl alcohol, and dextrose monohydrate, wherein an amount of the polymer preservative is sufficient to prevent the mirrored balloons from rising to the ceiling, but not to hold the mirrored balloons to the floor.

4. The room installation as claimed in claim 1, wherein the designated pattern within the room installation is a substantially circular pattern.

5. The room installation as claimed in claim 1, wherein the designated pattern within the room installation is a substantially linear pattern.

6. The room installation as claimed in claim 1, wherein the plurality of mirrored balloons include balloons of different sizes.

7. The room installation as claimed in claim 1, wherein the room installation further includes at least a plurality of light fixtures configured to shine light toward the mirrored balloons, the at least three walls, the floor, and the ceiling.

8. The room installation as claimed in claim 7, wherein the light fixtures are vertically affixed to column structures that are disposed near the at least one transparent window.

* * * * *